US010524039B2

(12) United States Patent
Ooi et al.

(10) Patent No.: US 10,524,039 B2
(45) Date of Patent: Dec. 31, 2019

(54) ENHANCED DIGITAL HEADSETS

(71) Applicant: Google LLC, Mountain View, CA (US)

(72) Inventors: Leng Ooi, San Jose, CA (US); Changzhan Gu, Milpitas, CA (US); Jae-won Hwang, Menlo Park, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/980,059

(22) Filed: May 15, 2018

(65) Prior Publication Data

US 2019/0356977 A1 Nov. 21, 2019

(51) Int. Cl.
*H04R 1/10* (2006.01)

(52) U.S. Cl.
CPC ..... *H04R 1/1041* (2013.01); *H04R 1/1016* (2013.01); *H04R 1/1033* (2013.01); *H04R 2420/09* (2013.01)

(58) Field of Classification Search
USPC ..... 381/74, 71.1, 109, 189, 355
See application file for complete search history.

(56) References Cited

U.S. PATENT DOCUMENTS

| | | | | |
|---|---|---|---|---|
| 7,243,851 | B2 | 7/2007 | Zhu et al. | |
| 7,328,047 | B2 | 2/2008 | Zhu et al. | |
| 7,398,072 | B2 | 7/2008 | Corrigan et al. | |
| 7,623,667 | B2 | 11/2009 | Sander et al. | |
| 8,483,401 | B2 | 7/2013 | Sampimom et al. | |
| 9,510,081 | B2 | 11/2016 | Jiang | |
| 2010/0067714 | A1* | 3/2010 | Cheng | H04R 1/2857 381/74 |
| 2010/0185432 | A1 | 7/2010 | Almagro | |
| 2011/0116646 | A1 | 5/2011 | Sander et al. | |
| 2011/0116750 | A1* | 5/2011 | Terlizzi | G02B 6/3817 385/88 |

(Continued)

FOREIGN PATENT DOCUMENTS

| | | | |
|---|---|---|---|
| CN | 202841469 | U | 3/2013 |
| CN | 203133830 | U | 8/2013 |

(Continued)

OTHER PUBLICATIONS

'appleinsider.com' [online] "Teardown finds DAC chips in Apple's Lightning EarPods & Lightning-to-3.5mm adapter for iPhone7," Roger Fingas, Sep. 20, 2016, [retrieved on Nov. 16, 2017] Retrieved from Internet: URL< http://appleinsider.com/articles/16/09/20/teardown-finds-dac-chips-in-apples-lightning-earpods-lightning-to-35mm-adapter-for-iphone-7> 8 pages.

(Continued)

*Primary Examiner* — Yosef K Laekemariam
(74) *Attorney, Agent, or Firm* — Fish & Richardson P.C.

(57) ABSTRACT

Methods, systems, and devices for enhanced digital headsets are disclosed. An enhanced USB-C headset includes a USB-C connector, a cable extending from the USB-C connector, an inline control box coupled to the USB-C connector through the cable, and a first earphone and a second earphone. The cable includes conductors for transmitting DC bus power, power return, and differential digital signals and extends at least one foot in length. The control box includes a single circuit board, with circuitry for managing digital communications, converting audio data, and providing output signals to drive analog speaker elements of the earphones.

20 Claims, 3 Drawing Sheets

(56) References Cited

U.S. PATENT DOCUMENTS

| | | | | |
|---|---|---|---|---|
| 2015/0373449 | A1* | 12/2015 | Jackson | H04R 1/1033 381/74 |
| 2016/0063986 | A1 | 3/2016 | Ben-Ami et al. | |

FOREIGN PATENT DOCUMENTS

| | | | |
|---|---|---|---|
| CN | 203574831 | U | 4/2014 |
| CN | 103873973 | A | 6/2014 |
| CN | 204632427 | U | 9/2015 |
| CN | 105721973 | A | 6/2016 |
| CN | 205722847 | U | 11/2016 |
| CN | 206865691 | U | 1/2018 |
| CN | 207200921 | U | 4/2018 |

OTHER PUBLICATIONS

'en.wikipedia.org' [online] "USB-C," Last updated: Apr. 17, 2018, [retrieved on Apr. 17, 2018] Retrieved from Internet: URL< https://en.wikipedia.org/wiki/USB-C> 9 pages.

'ifixit.org' [online] "Inside Apple's New Audio Adapter," Jeff Suovanen, Oct. 5, 2016, [retrieved on May 15, 2018] Retrieved from Internet: URL< https://ifixit.org/blog/8448/apple-audio-adapter-teardown/> 26 pages.

'lifehacker.com' [online] "Unleash Your Headphones Full Potential with a USB DAC and Amplifier," Whitson Gordon, Apr. 19, 2012, [retrieved on May 15, 2018] Retrieved from Internet: URL< https://lifehacker.com/5903575/unleash-your-headphones-full-potential-with-a-usb-dac-and-amplifier> 6 pages.

'www.cnet.com' [online] "No headphone jack, no problem: 7 ways to output audio from the iPhone 7," Justin Yu, Sep. 19, 2016, [retrieved on Nov. 16, 2017] Retrieved from Internet: URL< https://www.theverge.com/circuitbreaker/2017/10/4/16425738/google-pixel-2-usb-c-headphone-dongles-20-replacement> 11 pages.

'www.embedded.com' [online] "USB Type-C and power delivery 101 ac" Ports and Connections, Gayathri Vasudevan, May 8, 2017, [retrieved on May 3, 2018] Retrieved from Internet: URL< https://www.embedded.com/print/4458380> 7 pages.

www.ifixit.com [online] "Apple Lightning to Headphone Jack Adapter Teardown," Sep. 21, 2016, [retrieved on Nov. 16, 2017] Retrieved from Internet: URL< https://www.ifixit.com/Teardown/Apple+Lightning+to+Headphone+Jack+Adapter+Teardown/67562> 10 pages.

'www.theverge.com' [online] "Google's replacement Pixel 2 USB-C headphone dongles cost $20," Chaim Gartenberg, Oct. 4, 2017, [retrieved on Nov. 16, 2017] Retrieved from Internet: URL< https://www.theverge.com/circuitbreaker/2017/10/4/16425738/google-pixel-2-usb-c-headphone-dongles-20-replacement> 4 pages.

Conexant. "Conexant Introduces New Family of USB-C Audio CODECs, Redefines Possibilities for Audio Accessories," Press Release, Conexant, May 10, 2016, 3 pages.

Texas Instruments Incorporated. "USB Type-C Audio Adapter Accessory Mode Reference Design," TI Designs, TIDUB66, May 2016, 32 pages.

* cited by examiner

ENHANCED DIGITAL HEADSETS

BACKGROUND

People use headsets for many everyday activities, including making phone calls and listening to music and videos. Traditionally, many headsets have been designed to use analog audio inputs. Some devices output digital audio data, and so it may be desirable for headsets to receive and process digital audio inputs.

SUMMARY

In some implementations, a headset is configured to receive and process digital audio input. The headset can integrate circuitry for communicating over a digital interface and for processing digital audio input to the headset into a control box or "combox" of the headset. The control box may be placed along a cable of the headset, near the earphones and spaced apart from the connector that engages a digital communication port, for instance, a Universal Serial Bus (USB)-C port. The functionality of the headset, including audio control, audio processing (e.g., coding and/or decoding), communications processing, power management, and other analog and digital signal processing, can be combined onto one or more printed circuit boards (PCBs) that are located within the same control box. In some implementations, all of these functions may be performed by circuitry mounted on a single PCB. The control box can further be electromagnetically shielded, e.g., by including the PCB within a metal enclosure, to limit signal degradation from radio frequency (RF) or other electromagnetic interference. The wires along the cable connecting the control box to the earpieces, as well as the wires connecting the control box to the connector, can also be electromagnetically shielded.

In some implementations, the control box receives digitally-encoded audio signals from an audio device, such as a digital music player, a digital audio recorder, a phone, or a tablet computer. The control box converts the digital audio signals to one or more analog audio signals, e.g., by using an audio coder/decoder ("codec"). The control box can then provide the digital audio signals to one or more earpieces (e.g., speakers) worn by a user and connected to the control box. The audio codec may also convert received analog audio signals, e.g., from a microphone integrated into the control box or an earpiece, to digital signals. The control box can then provide the digital audio signals to the connected audio device, e.g., through a USB-C or other digital communications interface.

In some implementations, a Universal Serial Bus Type C (USB-C) headset includes a USB-C connector to receive direct current (DC) bus power and digital signals over a USB interface; a cable extending from the USB-C connector, where the cable having a length of one foot or more; an inline control box coupled to the USB-C connector through the cable; and a first earphone and a second earphone. The cable includes a power conductor for transmitting DC bus power, a ground conductor for power return, and a differential signaling pair of conductors for transmitting digital signals. The cable is further configured to space the inline control box apart from the USB-C connector with the length of the cable extending between the USB-C connector and the inline control box. The inline control box includes a single circuit board having associated circuitry mounted thereon that is powered by the DC bus power received over the USB interface. The associated circuitry comprises (i) USB interface circuitry configured to manage digital communication over the USB interface, (ii) decoding circuitry configured to convert digital audio data received over the differential signaling pair of conductors into stereo analog audio signals, and (iii) driver circuitry configured to provide at least two outputs to drive analog speaker elements based on the stereo audio signals. The first and second earphones each couple to the inline control box to respectively receive one of the outputs of the driver circuitry. The control box further includes an electromagnetic shielding element, the single circuit board and associated circuitry being housed within the electromagnetic shielding element.

In some implementations, the USB-C headset further includes one or more physical controls accessible at the exterior of the inline control box, where the one or more physical controls include at least one of a button, a slider, a dial, or a switch. In some implementations, the USB-C headset includes a plurality of buttons accessible at the exterior of the inline control box, each of the plurality of buttons being communicatively coupled with the single circuit board to control operation of the USB-C headset. In some implementations, the plurality of buttons are mounted to the single circuit board of the inline control box.

In some implementations, the differential signaling pair of conductors of the cable is a first digital signaling pair of conductors, and the cable further includes a second differential signaling pair of conductors, where the USB interface circuitry is configured to receive digital audio data through the first digital signaling pair of conductors and to transmit digital audio through the second digital signaling pair of conductors.

In some implementations, the inline control box includes a microphone, and the associated circuitry mounted on the single circuit board includes encoding circuitry configured to encode audio signals generated by the microphone as digital audio data transmitted over the USB interface.

In some implementations, the cable extends for at least at least two feet between the USB-C connector and the inline control box.

In some implementations, the earphones are each respectively connected to the inline control box by a respective cable that is at least 5 inches but not more than 18 inches long.

In some implementations, the cable includes an electromagnetic shielding layer that extends along the length of the cable and extends around at least the digital signaling pair of conductors. In some implementations, the electromagnetic shielding layer includes a wire braid, and the electromagnetic shielding element housing the circuit board is electrically connected with the wire braid.

In some implementations, the electromagnetic shielding element housing the circuit board is a metal can or metal sheath around the single circuit board and the associated circuitry.

In some implementations, the single circuit board of the control box has a top layer, a bottom layer, and multiple intermediate layers located between the top layer and bottom layer, wherein the top layer and bottom layers are ground plane metal layers, and the electromagnetic shielding element is electrically connected to the ground plane metal layers.

In some implementations, a USB-C headset includes a USB-C connector, a cable extending from the USB-C connector, a control box coupled to the USB-C connector through the cable, and earphones. The cable includes a power conductor for transmitting DC bus power, a ground conductor for power return, and a differential signaling pair of conductors for transmitting digital signals. The cable is further arranged to enable digital signals to be transmitted from the USB-C connector to the control box through the cable with the control box being spaced apart from the USB-C connector by one foot or more. The control box includes a circuit board having associated circuitry mounted on the circuit board, wherein the associated circuitry comprises (i) a USB interface integrated circuit, (ii) a codec integrated circuit to convert digital audio data into analog audio signals, and (iii) at least one audio power amplifier. The earphones are configured to receive outputs of the at least one audio power amplifier. The circuit board and associated circuitry are electromagnetically shielded by one or more metal elements extending around the circuit board and associated circuitry;

In some implementations, a method for operating a USB-C headset includes (i) receiving, at a USB-C connector of a headset, an input digital audio signal; (ii) transmitting the input digital audio signal from the USB-C connector to a control box along a cable permanently fixed between the USB-C connector and the control box, the cable being configured to space apart the USB-C connector from the control box by one foot or more; (iii) converting, at the control box, the digital audio signal into analog audio signals using decoding circuitry mounted on a circuit board in the control box, the control box comprising only a single circuit board; (iv) amplifying the analog audio signals using power amplifier circuitry mounted to the circuit board in the control box, the power amplifier circuitry being powered by USB bus power received through the USB-C connector; and (v) providing the amplified analog audio signals to earphones of the headset.

Other embodiments of these and other aspects of the disclosure include corresponding systems, apparatus, and computer programs, configured to perform the actions of the methods, encoded on non-transitory machine-readable storage devices. A system of one or more devices can be so configured by virtue of software, firmware, hardware, or a combination of them installed on the system that in operation cause the system to perform the actions. One or more computer programs can be so configured by virtue having instructions that, when executed by data processing apparatus, cause the apparatus to perform the actions.

Various implementations may provide one or more of the following advantages. For example, headphones that receive and process digital audio input can provide high audio quality. In an audio device such as a phone or tablet computer, the use of a digital connector, such as USB-C port, can enable the device to have a thinner form factor than devices with traditional analog headphone jack. Integrating the headset's electronic functionality into a single control box, which can contain a single PCB, reduces the design and material costs compared to traditional devices that require multiple separate PCBs placed at different locations along the headset cable. Locating audio and communications processing in a control box spaced apart from the connector (e.g., as opposed to including digital processing circuitry in or near the connector) reduces RF interference with antennas of the audio device (e.g., from an antenna of the audio device) on the electrical signal processing. Reduced RF interference provides a number of benefits, including better quality for cellular reception, Wi-Fi reception, and other RF communication by the audio device, potentially also allowing reduced power consumption and increased battery life. The location of the processing circuitry also provides greater audio signal integrity and lessens the computing resources required to provide a desired level of operational reliability (e.g., by reducing the need for error correction).

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
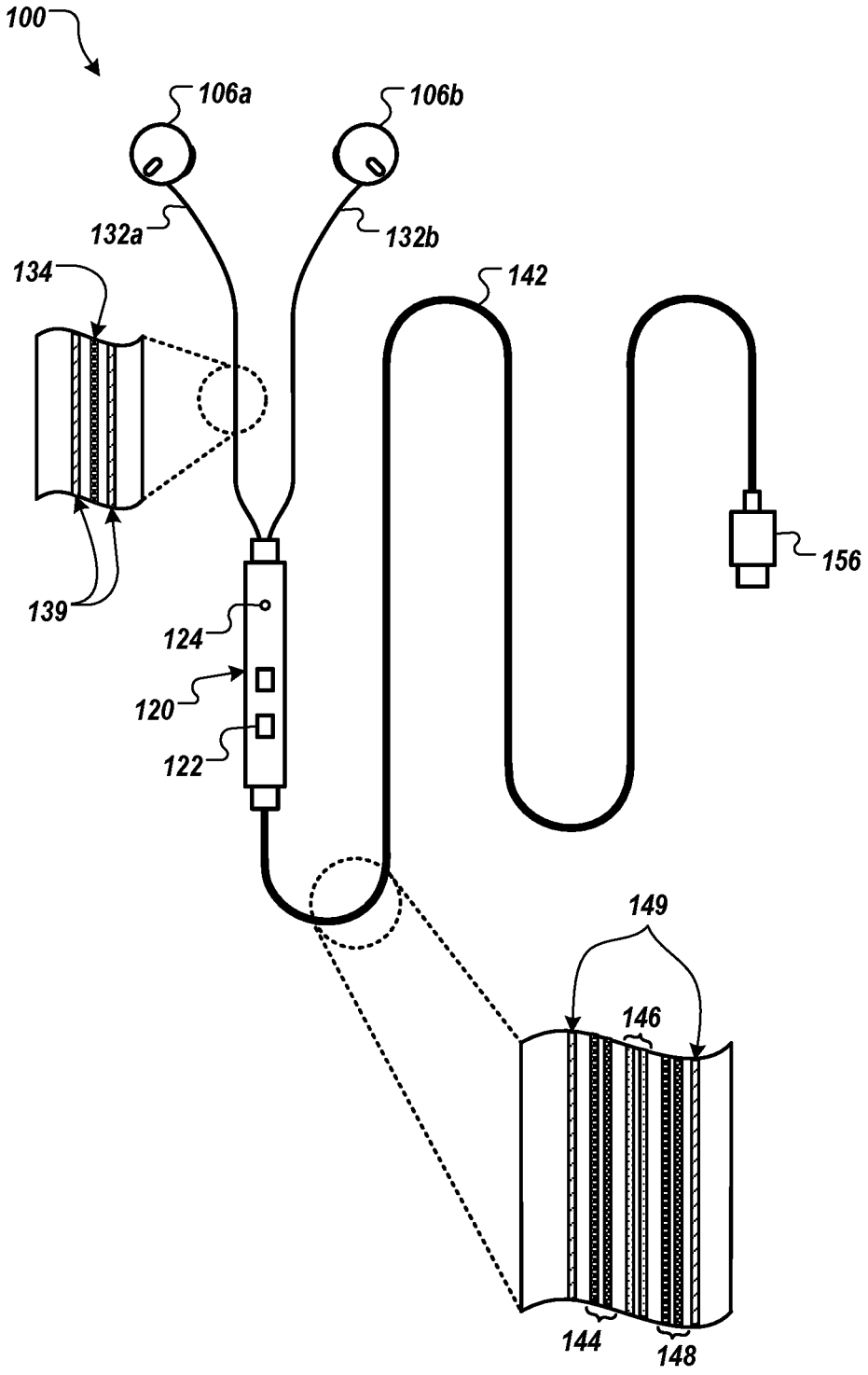
FIG. 1 is a diagram that illustrates an example of an enhanced digital headset.

FIG. 1 is a diagram that illustrates an example of an enhanced digital headset 100. The headset 100 includes two earpieces 106*a*, 106*b* connected to a control box 120 through cables 132*a*, 132*b*, respectively. The cables 132*a*, 132*b* include one or more wires 134 that carry analog audio signals between the earpieces 106*a*, 106*b* and the control box 120, respectively. The control box 120 is also connected to a connector 156 through a cable 142. The connector 156 can attach to an audio device, such as a digital music player, a digital audio recorder, a phone, or a tablet computer. The cable 142 includes one or more wires 144, 146, 148 that carry digital signals between the control box 120 and the audio device to which the connector 156 is attached.

Each earpiece 106*a*, 106*b* includes at least one transducer for generating acoustic waves (e.g., sound) from one or more received audio signals. The earpieces 106*a*, 106*b* can be designed to attach to a user's left and right ear, respectively, and can have any of various form factors. For example, the earpieces 106*a*, 106*b* can include an in-ear design (e.g., an "earbud"), where each earpiece's transducer housing sits inside the outer portion of a user's ear canal. The earpieces 106*a*, 106*b* can also be an over-ear design (e.g., a "shell"), where the each earpiece's transducer is housed within a shell that covers the entire ear. In some implementations, the earpieces 106*a*, 106*b* are physically connected to each other by a headband which stabilizes the earpieces 106*a*, 106*b* on the user's head.

The earpiece transducers can be miniature speakers designed to convert an analog audio signal to an acoustic wave. The earpieces 106*a*, 106*b* may further include foam or other soft material to secure the earpieces 106*a*, 106*b* to the user's head or to create an acoustic seal to isolate the earpieces 106*a*, 106*b* from ambient noise.

In some implementations, either or both of the earpieces 106*a*, 106*b* may also include a microphone for converting detected sound to an analog electrical signal. The earpieces 106*a*, 106*b* can also include additional electronic components, for example, amplifiers, sensors, modulators or demodulators, potentiometers, batteries, or other circuitry or circuit components.

The earpieces 106*a*, 106*b* connect to the control box 120 through cables 132*a*, 132*b*, respectively. In some implementations, the cables 132*a*, 132*b* can be between five inches and eighteen inches in length.

The cables 132*a*, 132*b* include one or more conducting wires 134 along which electrical signals can be transmitted between the earpieces 106*a*, 106*b* and the control box 120. For example, each cable 132*a*, 132*b* can include a signal wire 134 that carries the analog audio signals generated by the control box 120 to drive the transducers of the earpieces 106*a*, 106*b*. The transducers can convert the analog audio signal to acoustic waves to produce sound heard by the user. Each cable 132*a*, 132*b* can also include a ground wires 134 that provides an electrical reference for the electronic components of the earpieces 106*a*, 106*b*. In some implementations, the cables 132*a*, 132*b* also include wires 134 for carrying analog audio signals generated by a microphone integrated into one or more of the earpieces 106*a*, 106*b* to the control box 120. The cables 132*a*, 132*b* can also include wires 134 for carrying various other analog or digital signals, including control signals, power or ground signals, or other electrical data signals.

The cables 132*a*, 132*b* can also include shielding 139 to prevent or reduce degradation of the signals carried by the wires 134 from ambient RF or other electromagnetic interference. In some implementations, the shielding 139 can be a metal braid, e.g., a copper braid, a spiral-wrapped shield, or a flexible metal foil that surrounds the insulated wires 134 along the length of the cables 132*a*, 132*b*. The shielding 139 serves to intercept and attenuate ambient RF and electromagnetic signals that would otherwise interfere with the electrical signals transmitted along the wires 134.

The cables 132*a*, 132*b* carry analog audio signals between the earpieces 106*a*, 106*b*, respectively, and the inline control box 120. The control box 120 includes the various control and processing circuitry used by the headset 100 to receive and process audio inputs. The control box 120 can include one or more PCBs that implement the electronic circuits for receiving, transmitting, and processing audio signals sent between the audio device and the earpieces 132*a*, 132*b*. For example, the control box 120 can implement circuitry including an audio processor (e.g., an audio codec) that converts audio signals between analog and digital formats. The control box 120 may include circuits for processing one or more control signals related to the audio signals (e.g., volume, playback, or pause selections). The control box 120 can also include circuitry for implementing a particular digital communication standard or protocol, e.g., the Universal Serial Bus (USB) serial digital communication standard, to enable communication with an attached audio device. The control box 120 circuitry can also perform operations related to power management or other operations required for the headset's functionality. In some implementations, the control box 120 circuitry is surrounded by a metal enclosure to provide shielding from ambient RF or other electromagnetic interference. An example of the control box 120 circuitry is described in more detail in FIG. 2.

The control box 120 can also include one or more user controls 122. The controls 122 can be, e.g., buttons, dials, sliders, switches, levers, or other actuators that allow the user to control various parameters related to the operation of the headset 100. For example, the controls 122 can include power (e.g., on/off), volume control, recording, pause, or playback buttons that control or modify the audio operation of the headset 100. Actuation of a control 122 by the user can cause the control box 120 to generate one or more electronic signals that are provided as input to control circuitry, causing the headset 100 to perform the particular operation indicated by the actuated control 122 (e.g., changing a power state of the headset 100, increasing the volume of the audio playback, etc.). In some implementations, one or more of the controls 122 can be mounted to a circuit board of the control box 120.

In some implementations, the control box 120 also includes a microphone 124. The microphone can be a hardware component integrated into the control box 120 that converts detected acoustic waves into analog audio electrical signals. The audio signals can be routed to a circuit of the control box 120 for processing.

In some implementations, the headset 100 includes a microphone between the earpieces 106*a*, 106*b* and the control box 120. For example, a microphone may be integrated into a segment located along cable 132*a* or cable 132*b* and the audio and control signals for the microphone can be transmitted along one or more wires of the cable.

The control box 120 connects to a digital connector 156 through a cable 142. The cable 142 can include one or more conducting wires 144, 146, 148 that are surrounded by a shield 149. The shield 149 can be, for example, a metal braid, a spiral-wrapped shield, or a flexible metal foil that attenuates ambient RF and other electromagnetic signals that would otherwise interfere with the electrical signals carried by the wires 144, 146, 148. In some implementations, the cable 142 can extend in length from six inches to five feet.

The connector 156 can be a 24-pin USB-C connector or port, or another adapter for physically connecting to a digital audio device, such as a digital music player, a digital audio recorder, a phone, or a tablet computer. For example, the connector 156 can be a USB-A, USB-B, USB-C, micro USB-A, micro USB-B, USB mini, or Firewire type connector. The digital connector 156 can be configured to receive direct current (DC) bus power and digital signals over a USB interface.

The connector 156 can be male, female, or any other configuration designed to mate with a receptacle of an audio device. In some implementations, the digital connector 156 does not contain any active components, e.g., digital data conversion is accomplished by the circuitry of the control box 120, and the cable 142 carries digital data signals between the control box 120 and the audio device. In some implementations, the connector 156 can be designed to compensate for mechanical stresses expected or measured at the connection (e.g., provide stress relief).

In some implementations, the headset 100 can communicate with the audio device through a USB digital communication protocol. The cable 142 can thus include wires 144, 146, 148 for carrying the various power, ground, communication, and digital data signals necessary to implement the USB protocol. For example, the cable 142 can include one or more wires 144 for transmitting a DC bus power, as well as one or more wires 148 for carrying a return ground or power signal. The cable 142 can also include one or more differential pairs of wires 146 for carrying digital data, where each pair of wires 146 provides one channel of differential signal data.

For some USB standards (e.g., USB 3.0), the cable 142 can also include additional differential pairs of wires for "SuperSpeed" data transfer. In some implementations, one or more pairs of wires may serve dedicated functions (e.g., dedicated send and receive pairs). The cable 142 can also include wires for carrying other signals (e.g., for communicating configuration or other data).

In some implementations, the electronic circuitry of the inline control box 120 is integrated into a single circuit board situated within the housing of the control box 120. In particular, the control processing, the audio processing and the digital communications functions of the control box 120 can be integrated into a single board and located at one end of the cable 142, which is some distance (e.g., six inches to 24 inches) from the connector 156 that attaches to an audio device. The colocation of the control processing, the audio processing, and the digital communication functionality differs from traditional headsets, which can contain multiple separate circuits located at different locations along the length of the cable 142.

For example, a traditional headset may include one set of circuits located at a connector for implementing the digital communication operations (e.g., the USB interface processing) and some audio processing (e.g., the audio codec) and a second set of circuits located further along the length of the cable for performing control processing (e.g., volume, playback selection) and additional audio processing (e.g., amplification, audio signal reception).

In this configuration, the circuitry located at the connector can be in close proximity to electronic components of the audio device to which the connector is attached, which can make the circuitry susceptible to RF and electromagnetic interference. For example, the audio device may include one or more antennas (e.g., for Wi-Fi, Bluetooth, LTE, or other wireless data communications). The antennas can be situated within the audio device such that RF and electromagnetic radiation from the antennas can interfere with the electronic circuitry located in the connector, degrading the audio signals sent to or received from the earpieces. As a result, the headset may require special design considerations, such as additional shielding at the connector or particular circuit configurations, to mitigate the impact of RF and electromagnetic interference from the audio device.

In the enhanced digital headset 100, the control processing, the audio processing, and the digital communication circuitry is located in the control box 120 at the end of the cable 142, which is some distance (e.g., six inches to five feet) away from the audio device. By moving the circuitry further from the audio device, the impact of RF and electromagnetic radiation from antennas, or other audio device components, on the headset circuitry is considerably lessened. The reduced impact of RF and other electromagnetic transmissions can improve signal processing integrity of the headset circuitry and/or relax design constraints on the headset components.

While various lengths of the cable 142 are possible, a cable length of one foot or more typically provides sufficient separation between the control box 120 and the connected audio device to reduce the impact of interference from the audio device components on the control box 120 circuitry. Furthermore, as the intensity of RF and electromagnetic radiation scales inversely with distance, longer cable lengths, and thus greater separation between the control box 120 and the audio device, can further reduce the mutual interference between the control box 120 circuitry and the audio device electronics, while cable lengths significantly less than one foot may lead to increased interference and degraded signal quality.

Furthermore, by integrating the electronic functionality of the headset 100 into the control box 120, the total number of PCBs required can be reduced, for example, from multiple PCBs to a single PCB, which can simplify the design and production process (e.g., by requiring a mechanical design for, and manufacture of, only one board) and reduce the associated costs.

Figure 2:
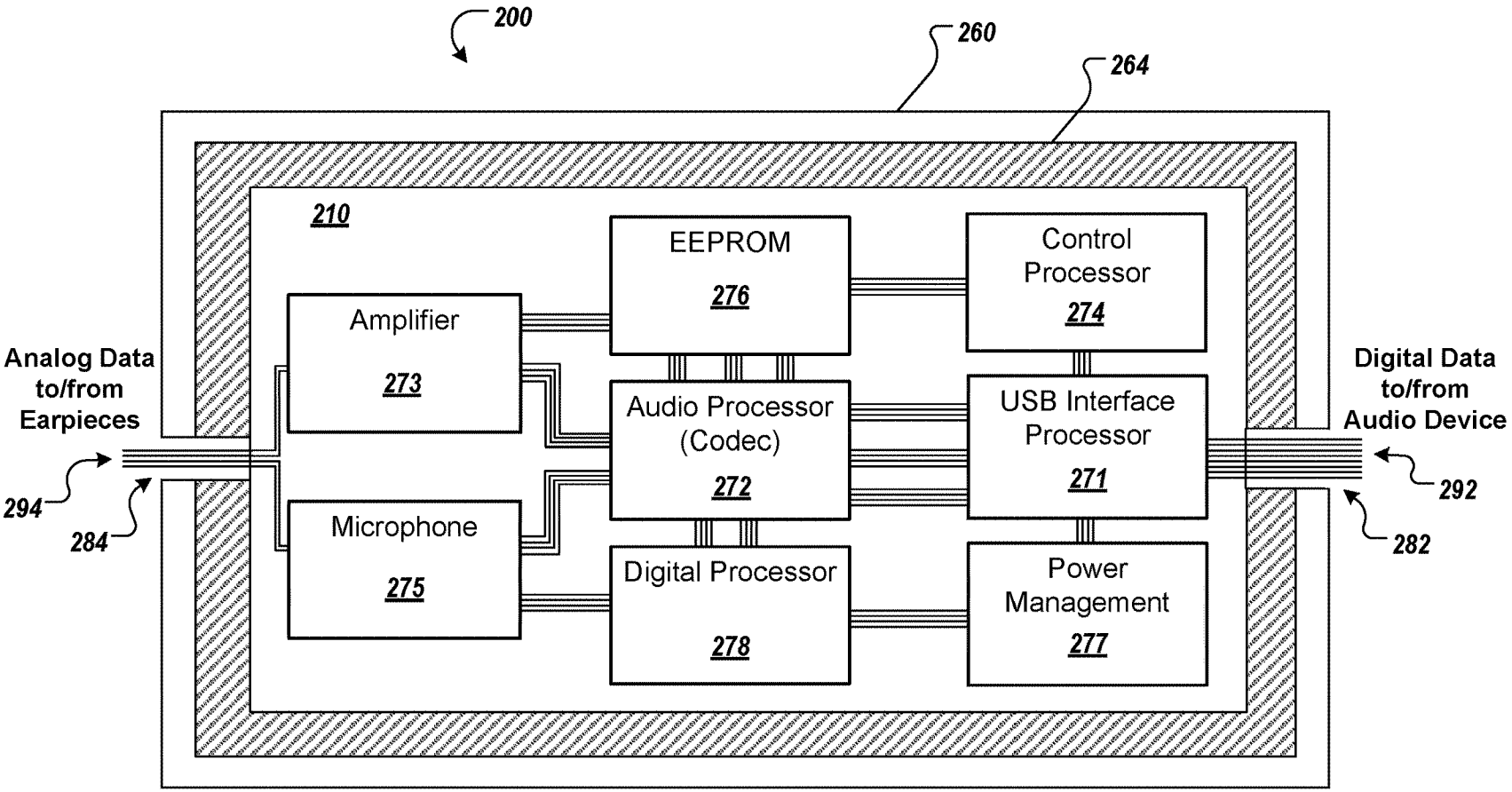
FIG. 2 is a diagram that illustrates an example of a control box for an enhanced digital headset.

FIG. 2 is a diagram that illustrates an example of a control box 200 for an enhanced digital headset, such as the headset 100 of FIG. 1. The control box 200 can be located, for example, along a cable some distance (e.g., six inches to 24 inches) from a connector that attaches the headset to an audio device. The control box 200 can also connect to one or more earpieces. In some implementations, the control box 200 includes signal lines 292 for exchanging digital data and/or other signals with the audio device and signal lines 294 for exchanging analog data and/or other signals with the one or more earpieces. The control box 200 also includes one or more circuit boards 210 that are located within the control box housing 260. The circuit boards 210 include circuit blocks 271, 272, 273, 274, 275, 276, 277, 278 ("271-278") that perform various operations for receiving and processing audio input.

In more detail, the control box 200 includes one or more circuit boards 210, which can be, for example printed circuit boards (PCBs) or other platforms or structures for integrating electronic components. The circuit boards 210 can be multilayer, as described in FIG. 3, and can include metallic traces for carrying analog and/or digital data signals, distributing power signals, providing ground signals, or for other electronic purposes. The circuit boards 210 can be further populated with one or more electronic components, including integrated circuits (ICs) and/or discrete electronic components (e.g., capacitors, resistors, inductors, switches, or other electronic components).

The circuit boards 210 are situated in the control box housing 260. The housing 260 can be, for example, a molded plastic case that provides mechanical support and protection for the circuit boards 210. In some implementations, the housing 260 may provide a seal that prevents contaminants from contacting the circuit boards 210.

The circuit boards 210 can include one or more connections 282, 284 for receiving signals from or sending signals to the audio device and the one or more earpieces. The circuit board 210 in FIG. 2 includes connection 282 for connecting the signal lines 292 to the audio device and connection 284 for connecting the signal lines 294 to the earpieces. The connections 282, 284 can be, for example, wire bonds, electrical junctions, point connections, or other connectors that enable routing of electronic signals onto and off of the circuit board 210. For example, the connection 282 may allow the signal lines 292 to be electrically connected to one or more cables connected to the earpieces (e.g., the cables 132*a*, 132*b* of FIG. 1), while the connection 284 may allow the signal lines 294 to be electrically connected to a cable connected to the audio device (e.g., the cable 142 of FIG. 1).

The circuit boards 210 further include one or more circuit blocks 271-278 for performing the various operations of the headset, such as control processing, audio processing, digital communication functionality, power management, or other operations. The circuit blocks 271-278 can be implemented in any combination of ICs, discrete components, or other electronic hardware. The circuit board 210 of control box 200 includes the circuit blocks 271-278, which are described in more detail below. As shown in FIG. 2, the circuit board 210 can also include metal traces that route signals between one or more blocks and distribute power and ground signals to the blocks as required. The signal routing shown in FIG. 2 is merely representative. The actual signal routing scheme for any particular circuit board 210 will differ from that shown in FIG. 2 and will depend upon the particular circuit configuration and layout implemented by the circuit board 210.

The circuit board 210 can include a USB interface processor 271 for managing digital communications between the circuit board 210 and the audio device. The USB interface processor 271 can include an IC that performs the various processing operations necessary to control and/or implement (e.g., to code and decode) the digital communication protocol used by the headset. For example, the USB interface processor 271 can include an IC that implements a USB digital communication standard (e.g., USB 2.0, USB 3.0, USB 3.1, USB 3.2). In some implementations, the USB interface processor 271 may receive and digital signals representing audio data from the audio device. In some implementations, the USB interface processor 271 may perform various other functions, including power management and distribution, data management, and other communications functions.

The circuit board 210 also can include a digital processor 278, which may be, for example, an embedded processor, a central processing unit (CPU), or other computational processing device. The digital processor 278 can receive electrical signals and/or data from the various other circuit blocks and perform various computing and processing operations for the headset. For example, the digital processor 278 can receive data from the USB interface processor 271, process the data, and/or distribute the data to other circuits of the control box 200. In some implementations, the digital processor 278 may coordinate the operations of the various circuit blocks.

The circuit board 210 also includes an audio processor 272. The audio processor 272 can be, for example, an audio coder/decoder ("codec"). The audio processor 272 can include various circuits and/or ICs for converting a digital signal representing audio data into an analog audio signal. For example, the audio processor 272 can include one or more decoders and/or one or more digital-to-analog converters (DACs) to output analog audio signals from digital data. In some implementations, the audio processor 272 may convert digital data to stereo analog audio signals.

Similarly, the audio processor 272 can include various circuits and/or ICs for converting an analog audio signal into a digital signal representing audio data. For example, the audio processor 272 can include one or more coders and/or one or more analog-to-digital converters (ADCs) to generate a digital signal representing the analog audio data.

In some implementations, the audio processor 272 receives digital data representing an audio signal from another circuit block (e.g., from the digital processor 278, from the USB interface processor 271, or from another circuit block). The audio processor 272 may convert the digital data representing an audio signal to an analog audio signal.

In some implementations, analog audio output of the audio processor 272 is provided to an amplifier circuit block 273. The amplifier circuit block 273 can include one or more amplifiers, potentiometers, or other circuit components for adjusting one or more characteristics (e.g., an amplitude, an intensity, a voltage level, a current level) of an analog audio signal. The control box 200 can provide the adjusted analog audio signal output by the amplifier circuit block 273 to the one or more earpieces by sending the signal through the signal lines 294.

The circuit board 210 can also include a control processor 274. The control processor 274 can be one or more circuits that interface with user controls integrated into the control box 200 (e.g., the user controls 122 of FIG. 1). The control processor 274 can receive electrical control signals related to the selection or status of one or more of the user controls. The control processor 274 may then process and/or distribute the control signals to various other circuit blocks as necessary for headset operation. For example, the control processor 174 may send a signal indicating a volume control to the amplifier circuit block 273, which can adjust the analog audio signal in response to the volume control.

In some implementations, the circuit board 210 also includes a microphone circuit block 275. The microphone circuit block 275 can accept and process analog electrical signals related to audio input received through a microphone of the headset, e.g., the microphone 124 integrated into the control box 120 of FIG. 1, or one or more microphones included in the earpieces 106*a*, 106*b* of headset 100 of FIG. 1. In some implementations, the microphone circuit block 275 processes the analog signals related to the audio input and provides the signals to the audio processor 272. The audio processor 272 can convert the analog audio signal to one or more digital signals representing the audio input. The audio processor 272 may then provide the digital signals to one or more other circuit blocks (e.g., the digital processor 278, the USB interface processor 271, or another circuit block).

The circuit board 210 can also include one or more memory blocks, such as an electrically-erasable programmable read only memory (EEPROM) 276. The EEPROM 276 or other memory block can store parameters, settings, and data related to the configuration and/or operation of one or more circuit blocks. The EEPROM 276 can then provide signals representing one or more parameters, settings, or data to a circuit block to control or modify the operation of the block.

The circuit board 210 can also include a power management block 278. The power management block 278 may regulate and distribute power signals to the various circuit blocks of the control box 200. In some implementations, the control box 200 receives power signals from the audio device through the signal lines 292. The power management block 278 can receive the power signal through the lines 292 or from another circuit block (e.g., the USB interface processor), process and/or condition the power signal, then distribute power as necessary to the control box 200 circuitry.

In some implementations, the control box 200 may include a battery or other power generating device. The power management block 278 can regulate and process power signals received from the power generating device and distribute the processed power signals to various other control box 200 circuit blocks and components.

The circuit board 210 can also include other electronic components and circuit blocks. For example, the circuit board 210 can include a driver circuitry block, which provides output signals to drive the analog speakers or transducers of the earpieces. In some implementations, the driver circuitry block may provide two output signals, one to each of the earpieces (e.g., one output for each stereo audio signal).

The board 210 can also include analog processing circuits, clock circuits, memory circuits (e.g., random access memory (RAM), flash memory), LEDs, electronic display devices, or other electronic circuits or components used by the headset.

In some implementations, the one or more circuit boards 210 are surrounded by one or more metal enclosures 264. The enclosures 264 may be one or more metal boxes or foils within the control box housing 260 that enclose all or some of the circuitry of the circuit boards 210. The enclosures 264 shield the circuits from ambient RF and/or electromagnetic transmissions that can interfere with circuit operation. In some examples, the enclosures 264 may be grounded, for example, by being electrically connected to one or more ground connections or ground planes of the circuit boards 210.

Figure 3:
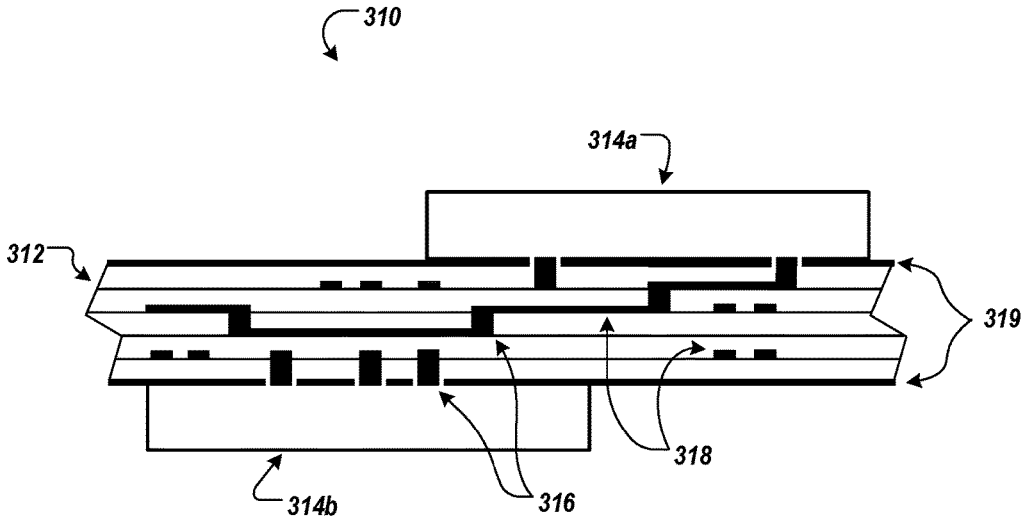
FIG. 3 is a diagram that illustrates a cross-section of an example of a control box circuit board for an enhanced digital headset.

FIG. 3 is a diagram that illustrates a cross-section of an example of a control box circuit board 310 for an enhanced digital headset. The circuit board 310 can be, for example, the circuit board 210 of FIG. 2. The circuit board 310 includes a printed circuit board (PCB) 312, which supports various electronic components, including ICs 314*a*, 314*b*. The circuit board 310 can incorporate multiple metallization layers, with conductive vias 316 and in-layer conductive traces 318 for making electrical connections between the various electronic components and circuit blocks.

The circuit board 310 can include a PCB 312, which may include multiple layers of dielectric material (e.g., FR4, a polyimide, epoxy, resin, or other dielectric laminate) separated by layers that contain conductive traces 318 that route electronic signals within a layer. The PCB 312 of FIG. 3 includes 6 metallization layers, but other numbers of layers are also possible (e.g., 4 layers, 8 layers). The PCB 312 can also include conductive vias 316 which electrically connect traces 318 in different layers.

The circuit board 310 supports multiple electronic components, including the ICs 314*a*, 314*b*. The components can be mounted on the top, bottom, or both the top and bottom surfaces. The input and output connections of the ICs 314*a*, 314*b* and other electrical components can be electrically connected to conductive traces 318 through one or more of the conductive vias 316, with the traces 318 and vias 316 configured to enable appropriate signal routing between components.

In some implementations, one or more of the metallization layers of the PCB 312 can include a large conductive area (e.g., a majority of the area of the layer) that is metallized to serve as a ground plane. In FIG. 3, the top and bottom metallization layers 319 include large conductive areas (e.g., substantially all of the layer) that aid in shielding the signals carried by the conductive traces 318 and vias 316 from degradation or interference by ambient RF and other electromagnetic radiation.

In some implementations, the headset includes a USB-C connector or port to receive direct current (DC) bus power and digital signals over a USB interface, a cable extending from the USB-C connector, an inline control box coupled to the USB-C connector through the cable, and two earphones.

The cable can have a length of one foot or more and can include a power conductor for transmitting DC bus power, a ground conductor for power return, and a differential signaling pair of conductors for transmitting digital signals. The cable can be configured to space the inline control box apart from the USB-C connector with the length of the cable extending between the USB-C connector and the inline control box. In some implementations, the cable extends for at least two feet between the USB-C connector and the inline control box.

The inline control box can include a single circuit board with associated circuitry mounted on the board. The circuitry can be powered by the DC bus power received over the USB interface and can include (i) USB interface circuitry configured to manage digital communication over the USB interface, (ii) decoding circuitry configured to convert digital audio data received over the differential signaling pair of conductors into stereo analog audio signals, and (iii) driver circuitry configured to provide at least two outputs to drive analog speaker elements based on the stereo audio signals.

The two earphones can each be coupled to the inline control box to respectively receive one of the outputs of the driver circuitry. In some implementations, the earphones are each respectively connected to the inline control box by a respective cable that is at least 5 inches but not more than 18 inches long.

The control box can further include an electromagnetic shielding element, such as a metal can or metal sheath, where the single circuit board and associated circuitry are housed within the electromagnetic shielding element.

In some implementations, the single circuit board of the control box has a top layer, a bottom layer, and multiple intermediate layers located between the top and bottom layers. The top and bottom layers can be ground plane metal layers, and the electromagnetic shielding element of the control box can be electrically connected to the ground plane metal layers.

In some implementations, the cable also includes an electromagnetic shielding layer that extends along the length of the cable and at least around the digital signaling pair of conductors. The electromagnetic shielding layer can be, for example, a wire braid, and the electromagnetic shielding element of the control box can be electrically connected with the wire braid.

In some implementations, the cable can include two differential signaling pairs of conductors, where the USB interface circuitry is configured to receive digital audio data through a first digital signaling pair of conductors and to transmit digital audio through a second digital signaling pair of conductors.

In some implementations, the inline control box includes a microphone, and the circuitry of the single circuit board includes encoding circuitry configured to encode audio signals generated by the microphone as digital audio data for transmission over the USB interface.

In some implementations, the headset also includes one or more physical controls accessible at the exterior of the inline control box. The one or more physical controls can include one or more of a button, a slider, a dial, or a switch. In some implementations, the headset includes a plurality of buttons accessible at the exterior of the inline control box, where each of the plurality of buttons is communicatively coupled with the single circuit board to control the operation of the headset. In some implementations, the plurality of buttons are mounted to the single circuit board.

In some implementations, the control box is coupled to the USB-C connector through the cable and the cable arranged to enable digital signals to be transmitted from the USB-C connector to the control box through the cable with the control box being spaced apart from the USB-C connector by one foot or more.

In some implementations, the control box can include a circuit board, with associated circuitry mounted on the circuit board, where the circuitry includes (i) a USB interface integrated circuit, (ii) a codec integrated circuit to convert digital audio data into analog audio signals, and (iii) at least one audio power amplifier. Furthermore, the circuit board and associated circuitry can be electromagnetically shielded by one or more metal elements extending around the circuit board and the circuitry. Here, the earphones of the headset can be configured to receive outputs of the at least one audio power amplifier.

In some implementations, a USB-C headset can implement a method that includes: (i) receiving, at a USB-C connector of the headset, an input digital audio signal; (ii) transmitting the input digital audio signal from the USB-C connector to a control box along a cable permanently fixed between the USB-C connector and the control box, the cable being configured to space apart the USB-C connector from the control box by one foot or more; (iii) converting, at the control box, the digital audio signal into analog audio signals using decoding circuitry mounted on a circuit board in the control box, the control box comprising only a single circuit board; (iv) amplifying the analog audio signals using power amplifier circuitry mounted to the circuit board in the control box, the power amplifier circuitry being powered by USB bus power received through the USB-C connector; and (v) providing the amplified analog audio signals to earphones of the headset.

Embodiments of the invention and all of the functional operations described in this specification may be implemented in digital electronic circuitry, or in computer software, firmware, or hardware, including the structures disclosed in this specification and their structural equivalents, or in combinations of one or more of them. Embodiments of the invention may be implemented as one or more computer program products, i.e., one or more modules of computer program instructions encoded on a computer-readable medium for execution by, or to control the operation of, data processing apparatus. The computer readable medium may be a non-transitory computer readable storage medium, a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus may include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) may be written in any form of programming language, including compiled or interpreted languages, and it may be deployed in any form, including as a stand-alone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform functions by operating on input data and generating output. The processes and logic flows may also be performed by, and apparatus may also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer may be embedded in another device, e.g., a tablet computer, a mobile telephone, a personal digital assistant (PDA), a mobile audio player, a Global Positioning System (GPS) receiver, to name just a few. Computer readable media suitable for storing computer program instructions and data include all forms of non-volatile memory, media, and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory may be supplemented by, or incorporated in, special purpose logic circuitry.

To provide for interaction with a user, embodiments of the invention may be implemented on a computer having a display device, e.g., a CRT (cathode ray tube) or LCD (liquid crystal display) monitor, for displaying information to the user and a keyboard and a pointing device, e.g., a mouse or a trackball, by which the user may provide input to the computer. Other kinds of devices may be used to provide for interaction with a user as well; for example, feedback provided to the user may be any form of sensory feedback, e.g., visual feedback, auditory feedback, or tactile feedback; and input from the user may be received in any form, including acoustic, speech, or tactile input.

Embodiments of the invention may be implemented in a computing system that includes a back end component, e.g., as a data server, or that includes a middleware component, e.g., an application server, or that includes a front end component, e.g., a client computer having a graphical user interface or a Web browser through which a user may interact with an implementation of the invention, or any combination of one or more such back end, middleware, or front end components. The components of the system may be interconnected by any form or medium of digital data communication, e.g., a communication network. Examples of communication networks include a local area network ("LAN") and a wide area network ("WAN"), e.g., the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments may also be implemented in combination in a single embodiment. Conversely, various features that are described in the context of a single embodiment may also be implemented in multiple embodiments separately or in any suitable subcombination. Moreover, although features may be described above as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems may generally be integrated together in a single software product or packaged into multiple software products.

In each instance where an HTML file is mentioned, other file types or formats may be substituted. For instance, an HTML file may be replaced by an XML, JSON, plain text, or other types of files. Moreover, where a table or hash table is mentioned, other data structures (such as spreadsheets, relational databases, or structured files) may be used.

Thus, particular embodiments of the invention have been described. Other embodiments are within the scope of the following claims. For example, the actions recited in the claims may be performed in a different order and still achieve desirable results.

What is claimed is:

1. A Universal Serial Bus Type C (USB-C) headset comprising:

a USB-C connector to receive direct current (DC) bus power and digital signals over a USB interface;

a cable extending from the USB-C connector, the cable comprising a power conductor for transmitting DC bus power, a ground conductor for power return, and a differential signaling pair of conductors for transmitting digital signals, the cable having a length of one foot or more;

an inline control box coupled to the USB-C connector through the cable, the inline control box comprising a single circuit board having associated circuitry mounted thereon that is powered by the DC bus power received over the USB interface, the cable being configured to space the inline control box apart from the USB-C connector with the length of the cable extending between the USB-C connector and the inline control box, wherein the associated circuitry comprises (i) USB interface circuitry configured to manage digital communication over the USB interface, (ii) decoding circuitry configured to convert digital audio data received over the differential signaling pair of conductors into stereo analog audio signals, and (iii) driver circuitry configured to provide at least two outputs to drive analog speaker elements based on the stereo audio signals;

a first earphone and a second earphone, the earphones each coupled to the inline control box to respectively receive one of the outputs of the driver circuitry;

wherein the control box includes an electromagnetic shielding element, the single circuit board and associated circuitry being housed within the electromagnetic shielding element.

2. The USB-C headset of claim 1, further comprising one or more physical controls accessible at an exterior of the inline control box, the one or more physical controls comprising at least one of a button, a slider, a dial, or a switch.

3. The USB-C headset of claim 2, further comprising a plurality of buttons accessible at the exterior of the inline control box, each of the plurality of buttons being communicatively coupled with the single circuit board to control operation of the USB-C headset.

4. The USB-C headset of claim 3, wherein the plurality of buttons are mounted to the single circuit board.

5. The USB-C headset of claim 1, wherein the differential signaling pair of conductors is a first differential signaling pair of conductors, and the cable further comprises a second differential signaling pair of conductors, wherein the USB interface circuitry is configured to receive digital audio data through the first differential signaling pair of conductors and to transmit digital audio data through the second differential signaling pair of conductors.

6. The USB-C headset of claim 5, wherein the inline control box comprises a microphone, and wherein the associated circuitry mounted on the single circuit board comprises encoding circuitry configured to encode audio signals generated by the microphone as digital audio data transmitted over the USB interface.

7. The USB-C headset of claim 1, wherein the cable extends for at least at least two feet between the USB-C connector and the inline control box.

8. The USB-C headset of claim 7, wherein the earphones are each respectively connected to the inline control box by a respective cable that is at least 5 inches but not more than 18 inches long.

9. The USB-C headset of claim 1, wherein the cable comprises an electromagnetic shielding layer that extends along the length of the cable and extends around at least the digital signaling pair of conductors.

10. The USB-C headset of claim 9, wherein the electromagnetic shielding layer comprises a wire braid, and the electromagnetic shielding element is electrically connected with the wire braid.

11. The USB-C headset of claim 1, wherein the electromagnetic shielding element is a metal can or metal sheath around the single circuit board and the associated circuitry.

12. The USB-C headset of claim 1, wherein the single circuit board has a top layer, a bottom layer, and multiple intermediate layers located between the top layer and bottom layer, wherein the top layer and bottom layers are ground plane metal layers, and the electromagnetic shielding element is electrically connected to the ground plane metal layers.

13. A Universal Serial Bus Type C (USB-C) headset comprising:

a USB-C connector;

a cable extending from the USB-C connector, the cable comprising a power conductor for transmitting DC bus power, a ground conductor for power return, and a differential signaling pair of conductors for transmitting digital signals;

a control box coupled to the USB-C connector through the cable, the cable arranged to enable digital signals to be transmitted from the USB-C connector to the control box through the cable with the control box being spaced apart from the USB-C connector by one foot or more, the control box comprising a circuit board having associated circuitry mounted on the circuit board, wherein the associated circuitry comprises (i) a USB interface integrated circuit, (ii) a codec integrated circuit to convert digital audio data into analog audio signals, and (iii) at least one audio power amplifier, the circuit board and associated circuitry being electromagnetically shielded by one or more metal elements extending around the circuit board and associated circuitry; and earphones configured to receive outputs of the at least one audio power amplifier.

14. The USB-C headset of claim 13, further comprising one or more physical controls accessible at an exterior of the control box, the one or more physical controls comprising at least one of a button, a slider, a dial, or a switch.

15. The USB-C headset of claim 14, further comprising a plurality of buttons accessible at the exterior of the control box, each of the plurality of buttons being communicatively coupled with the circuit board to control operation of the USB-C headset.

16. The USB-C headset of claim 15, wherein the plurality of buttons are mounted to the circuit board.

17. The USB-C headset of claim 13, wherein the differential signaling pair of conductors is a first differential signaling pair of conductors, and the cable further comprises a second differential signaling pair of conductors, wherein the USB interface integrated circuit is configured to receive digital audio data through the first differential signaling pair of conductors and to transmit digital audio data through the second differential signaling pair of conductors.

18. The USB-C headset of claim 17, wherein the control box comprises a microphone, and wherein the associated circuitry mounted on the circuit board comprises encoding circuitry configured to encode audio signals generated by the microphone as digital audio data transmitted over the USB interface.

19. The USB-C headset of claim 13, wherein the cable extends for at least at least two feet between the USB-C connector and the control box; and wherein the earphones are each respectively connected to the control box by a respective cable that is at least 5 inches but not more than 18 inches long.

20. A method comprising:

receiving, at a USB-C connector of a headset, an input digital audio signal;

transmitting the input digital audio signal from the USB-C connector to a control box along a cable permanently fixed between the USB-C connector and the control box, the cable being configured to space apart the USB-C connector from the control box by one foot or more;

converting, at the control box, the digital audio signal into analog audio signals using decoding circuitry mounted on a circuit board in the control box, the control box comprising only a single circuit board;

amplifying the analog audio signals using power amplifier circuitry mounted to the circuit board in the control box, the power amplifier circuitry being powered by USB bus power received through the USB-C connector; and providing the amplified analog audio signals to earphones of the headset.

* * * * *